US007207517B2

(12) United States Patent
McKendree et al.

(10) Patent No.: US 7,207,517 B2
(45) Date of Patent: Apr. 24, 2007

(54) MUNITION WITH INTEGRITY GATED GO/NO-GO DECISION

(75) Inventors: Thomas L. McKendree, Huntington Beach, CA (US); John D. Britigan, Orange, CA (US); Hans L. Habereder, Orange, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/056,977

(22) Filed: Feb. 11, 2005

(65) Prior Publication Data

US 2006/0038056 A1 Feb. 23, 2006

Related U.S. Application Data

(62) Division of application No. 10/444,937, filed on May 23, 2003, now Pat. No. 6,896,220.

(51) Int. Cl.
*F42B 15/01* (2006.01)

(52) U.S. Cl. ..... 244/3.15

(58) Field of Classification Search ..... 244/3.1–3.2, 244/3.11, 3.13, 3.14, 3.15, 3.16, 3.18, 3.17, 244/3.19; 89/1.11, 1.1; 342/166, 173, 357.01–357.17; 701/200, 207, 213–216, 218, 224; 700/21
See application file for complete search history.

(56) References Cited

U.S. PATENT DOCUMENTS 2,399,426 A 4/1946 Bradley
3,169,727 A 2/1965 Schroader et al.
3,617,016 A * 11/1971 Bolsey ..... 244/3.16
3,636,323 A 1/1972 Salisbury et al.
3,677,500 A * 7/1972 Brown et al. ..... 244/3.13
4,093,153 A 6/1978 Bardash et al.
4,193,688 A * 3/1980 Watkins ..... 356/139.04
4,489,656 A * 12/1984 Hennings et al. ..... 102/254
4,530,270 A 7/1985 Denaci
4,530,476 A * 7/1985 Thurber et al. ..... 244/3.21
4,611,771 A * 9/1986 Gibbons et al. ..... 244/3.12
4,730,793 A * 3/1988 Thurber et al. ..... 244/3.1

(Continued)

FOREIGN PATENT DOCUMENTS

EP 0 583 972 A1 2/1994

(Continued)

OTHER PUBLICATIONS

PCT/US2004/015619 PCT International Search Report dated Jun. 2, 2005.

(Continued)

*Primary Examiner*—Teri Pham Luu
*Assistant Examiner*—Stephen Holzen
(74) *Attorney, Agent, or Firm*—Daly, Crowley, Mofford & Durkee, LLP

(57) ABSTRACT

A munition is presented which includes an integrity verification system that measures the integrity of the munition. When an integrity threshold is not met, engagement of the munition with a predetermined target is aborted. Also presented is a methodology for gating the engagement of the munition with the target. The methodology includes performing an integrity check of the munition after it is deployed. The method further includes aborting the engagement of the target when the integrity check of the munition fails.

14 Claims, 8 Drawing Sheets

U.S. PATENT DOCUMENTS

| | | | | | |
|---|---|---|---|---|---|
| 4,739,401 | A | * | 4/1988 | Sacks et al. | 382/103 |
| H538 | H | * | 11/1988 | Betzold | 89/134 |
| 5,143,328 | A | * | 9/1992 | Leonard | 244/171.3 |
| 5,211,356 | A | * | 5/1993 | McWilliams et al. | 244/3.15 |
| 5,305,974 | A | * | 4/1994 | Willis | 244/171.5 |
| 5,414,347 | A | * | 5/1995 | Monk et al. | 324/73.1 |
| 5,465,212 | A | * | 11/1995 | Fowler et al. | 701/15 |
| 5,507,452 | A | | 4/1996 | Mayersak | |
| 5,635,940 | A | * | 6/1997 | Hickman et al. | 342/389 |
| 5,637,826 | A | * | 6/1997 | Bessacini et al. | 114/21.1 |
| 5,721,680 | A | * | 2/1998 | Van Cleve et al. | 701/3 |
| 5,741,609 | A | * | 4/1998 | Chen et al. | 429/307 |
| 5,742,609 | A | | 4/1998 | Kondrak et al. | |
| 5,755,400 | A | | 5/1998 | Kalms, III | |
| 5,760,737 | A | * | 6/1998 | Brenner | 342/357.02 |
| 5,785,279 | A | | 7/1998 | Gregory | |
| 5,881,969 | A | | 3/1999 | Miller | |
| 6,067,484 | A | | 5/2000 | Rowson et al. | |
| 6,142,411 | A | * | 11/2000 | Cobleigh | 244/3.14 |
| 6,152,041 | A | | 11/2000 | Harris et al. | |
| 6,237,496 | B1 | | 5/2001 | Abbott | |
| 6,254,031 | B1 | | 7/2001 | Mayersak | |
| 6,268,785 | B1 | * | 7/2001 | Kollman et al. | 336/83 |
| 6,307,514 | B1 | | 10/2001 | West | |
| 6,315,248 | B1 | * | 11/2001 | Rockwell | 244/158.5 |
| 6,317,688 | B1 | * | 11/2001 | Bruckner et al. | 701/213 |
| 6,429,808 | B1 | * | 8/2002 | King et al. | 342/357.02 |
| 6,474,592 | B1 | * | 11/2002 | Shnaps | 244/3.15 |
| 6,522,250 | B1 | | 2/2003 | Ernst et al. | |
| 6,621,059 | B1 | * | 9/2003 | Harris et al. | 244/3.2 |
| 6,654,685 | B2 | | 11/2003 | McIntyre | |
| 6,666,401 | B1 | * | 12/2003 | Mardirossian | 244/3.11 |
| 6,685,141 | B2 | * | 2/2004 | Penn | 244/171.1 |
| 6,711,478 | B2 | * | 3/2004 | Hilb | 701/8 |
| 6,796,213 | B1 | * | 9/2004 | McKendree et al. | 89/1.11 |
| 6,813,519 | B2 | * | 11/2004 | Lebel et al. | 607/32 |
| 6,839,662 | B2 | | 1/2005 | Schnatterly et al. | |
| 6,896,220 | B2 | | 5/2005 | McKendree et al. | |
| 6,898,554 | B2 | | 5/2005 | Jaw et al. | |
| 6,921,051 | B2 | * | 7/2005 | Lopata et al. | 244/158.9 |
| 6,940,811 | B2 | | 9/2005 | McDermott et al. | |
| 2002/0027878 | A1 | * | 3/2002 | McDermott et al. | 370/221 |
| 2002/0066054 | A1 | * | 5/2002 | Jaw et al. | 714/48 |
| 2002/0077731 | A1 | * | 6/2002 | Hilb | 701/4 |
| 2002/0171011 | A1 | * | 11/2002 | Lopata et al. | 244/172 |
| 2003/0140298 | A1 | * | 7/2003 | Koprivica | 714/758 |
| 2003/0213358 | A1 | | 11/2003 | Harding | |
| 2004/0006424 | A1 | * | 1/2004 | Joyce et al. | 701/207 |
| 2004/0243378 | A1 | * | 12/2004 | Schnatterly et al. | 703/22 |
| 2004/0245369 | A1 | | 12/2004 | McKendree et al. | |

FOREIGN PATENT DOCUMENTS

| | | |
|---|---|---|
| GB | 2 211 371 A | 6/1989 |
| WO | WO 99/02936 | 1/1999 |
| WO | WO 00/03193 | 1/2000 |

OTHER PUBLICATIONS

U.S. Military Weapons of War, Part 2: Non-Nuclear Bombs and Missles, http://usmilitary.about.com/library/weekly/aa032303a.htm. pp. 1-27.

PCT Search Report of Application No. PCT/US2004/015725 dated Mar. 7, 2005.

PCT Search Report of Application No. PCT/US2004/015643 dated Oct. 15, 2004.

Linn Roth and Jom Doty, GPS Safety Net GPS-Loran Tpye Prototype Processor, GPS World (http://www.gpsworld.com) May 1, 2003.

"Cheyenne Mountain Complex", no author given; copyrighted in the year 2000; posted at globalsecurity. org.

"NORAD", no author given; Department of National Defense of the Government of Canada; posted at www.dnd.ca.

Dr. George Lindsey, "Canada, NORAD and National Missile Defence"; In the publication "National Network News," (vol. 8, No. 2; Summer 2001); posted at www.sfu.edu.

Holeman, Dennis L., Impact of 1-Meter GPS Navigation on Warfighting, Apr. 4, 1996, pp. 530-537.

Preiss, Stephen A., Smart Weapon Bit and Reprogramming A Management Update, Oct. 10, 2002, pp. 164-173, vol. 38.

Snyder Scott, INS/GPS Operational Concept Demonstration (OCD) High Gear Program, Apr. 11, 1994, pp. 292-297.

Luthra Puran, FMECA: An Integrated Approach, 1991, pp. 235-241.

* cited by examiner

MUNITION WITH INTEGRITY GATED GO/NO-GO DECISION

CROSS REFERENCE TO RELATED APPLICATIONS

This application is a divisional of and claims the benefit of U.S. patent application Ser. No. 10/444,937, entitled Munition With Integrity Gated Go-No-Go Decision, filed on May 23, 2003 now U.S. Pat. No. 6,896,220, which application is hereby incorporated by reference in its entirety.

STATEMENT REGARDING FEDERALLY SPONSORED RESEARCH

Not Applicable.

FIELD OF THE INVENTION

The present invention relates generally to munitions used in warfare, and more particularly to a method of controlling the munitions to avoid engagement of undesired targets, such as friendly or neutral troops or sites.

BACKGROUND OF THE INVENTION

Modern warfare often involves enemy troops located close to civilian population and to friendly troops. While it is desirable to engage the enemy troops and enemy sites, care must be used to minimize or eliminate unintentional engagement of friendly troops and/or collateral damage.

In modern warfare the targeting of enemy sites is typically focused on the increasing probability of munitions hitting the desired target, typically with means to improve overall weapon accuracy. Certain countries or groups of people place air defense systems and other military significant systems near buildings such as hospitals, schools or places of religious worship (e.g. churches, temples or mosques) in hope that an attempted targeting of the military significant systems will be tempered by the desire not to hurt civilians in the hospitals, schools or places of religious worship or to harm the buildings themselves.

Present day munitions used in warfare are increasingly Precision Guided Munitions (PGMs). A "PGM" is a munition with sensors that allow it to know where it is and actuators that allow the munition to guide itself towards an intended target. The PGM's guidance system provides a generally accurate target area for the munitions to strike. These munitions target an aim point. The aim point has an area around it referred to as the Circular Error Probable (CEP). The CEP defines an area about an aim point for a munition wherein approximately fifty percent of the munitions aimed at the aim point of the target will strike. While fifty percent of the munitions will strike within the CEP area, the remaining fifty percent will strike outside the CEP area, in some cases potentially very far away. It is munitions that strike away from the intended target that result in unintentional engagement of friendly troops or friendly sites or provide collateral damage to civilians and civilian structures.

One system used to provide guidance of a PGM is known as a Laser Guidance System (LGS) used with Laser Guided Bombs (LGBs). In use, a LGB maintains a flight path established by the delivery aircraft. The LGB attempts to align itself with a target that is illuminated by a laser. The laser may be located on the delivery aircraft, on another aircraft or on the ground. When alignment occurs between the LGB and the laser, the reflected laser energy is received by a detector of the LGB and is used to center the LGB flight path on the target.

Another type of PGM is known as an Inertial Guided Munition (IGM). The IGM utilizes an inertial guidance system (IGS) to guide the munition to the intended target. This IGS uses a gyroscope and accelerometer to maintain the predetermined course to the target.

Still another type of PGM is referred to as Seeker Guided Munitions (SGMs). The SGMs attempt to determine a target with either a television or an imaging infrared seeker and a data link. The seeker subsystem of the SGM provides the launch aircraft with a visual presentation of the target as seen from the munition. During munition flight, this presentation is transmitted by the data-link system to the aircraft cockpit monitor. The SGM can be either locked onto the target before or after launch for automatic munition guidance. As the target comes into view, the SGM locks onto the target.

Another navigation system used for PGMs is known as a Global Positioning System (GPS). GPS is well known to those in the aviation field for guiding aircraft. GPS is a satellite navigation system that provides coded satellite signals that are processed by a GPS receiver and enable the receiver to determine position, velocity and time. Generally four satellite signals are used to compute position in three dimensions and a time offset in the receiver clock. A GPS satellite navigation system has three segments: a space segment, a control segment and a user segment.

The GPS space segment is comprised of a group of GPS satellites, known as the GPS Operations Constellation. A total of 24 satellites (plus spares) comprise the constellation, with the orbit altitude of each satellite selected such that the satellites repeat the same ground track and configuration over any point each 24 hours. There are six orbital planes with four satellites in each plane. The planes are equally spaced apart (60 degrees between each plane). The constellation provides between five and eight satellites visible from any point on the earth, at any one time.

The GPS control segment comprises a system of tracking stations located around the world. These stations measure signals from the GPS satellites and incorporate these signals into orbital models for each satellite. The models compute precise orbital data (ephemeris) and clock corrections for each satellite. A master control station uploads the ephemeris data and clock data to the satellites. The satellites then send subsets of the orbital ephemeris data to GPS receivers via radio signals.

The GPS user segment comprises the GPS receivers. GPS receivers convert the satellite signals into position, velocity and time estimates. Four satellites are required to compute the X, Y, Z positions and the time. Position in the X, Y and Z dimensions are converted within the receiver to geodetic latitude, longitude and height. Velocity is computed from change in position over time and the satellite Doppler frequencies. Time is computed in satellite time and GPS time. Satellite time is maintained by each satellite. Each satellite contains four atomic clocks that are monitored by the ground control stations and maintained to within one millisecond of GPS time.

Each satellite transmits two microwave carrier signals. The first carrier signal carries the navigation message and code signals. The second carrier signal is used to measure the ionospheric delay by Precise Positioning Service (PPS) equipped receivers. The GPS navigation message comprises a 50 Hz signal that includes data bits that describe the GPS satellite orbits, clock corrections and other system parameters. Additional carriers, codes and signals are expected to be added to provide increased accuracy and integrity.

A system used to provide even greater accuracy for GPS systems used in navigation applications is known as a Space Based Augmentation System. One type of SBAS is known as a Wide Area Augmentation System (WAAS). WAAS is a system of satellites and ground stations that provide GPS signal correction to provide greater position accuracy. WAAS is comprised of approximately 25 ground reference stations that monitor GPS satellite data. Two master stations collect data from the reference stations and produce a GPS correction message. The correction message corrects for GPS satellite orbit and clock drift and for signal delays caused by the atmosphere and ionosphere. The corrected message is broadcast through one of the WAAS geostationary satellites and can be read by a WAAS-enabled GPS receiver.

Some PGMs combine multiple types of guidance. For example, the Joint Direct Attack Munition (JDAM) uses GPS, but includes inertial guidance, which it uses to continue an engagement if the GPS signal becomes jammed.

A drawback associated with all these types of PGMs is the unintentional engagement of friendly or neutral targets. While LGBs have proven effective, a variety of factors such as sensor alignment, control system malfunction, smoke, dust, debris, and weather conditions can result in the LGB not hitting the desired target. SGMs may be confused by decoys. The image obtained by the SGM may be distorted by weather or battle conditions such as smoke and debris and result in the SGM not being able to lock onto the target. There are several areas where GPS errors can occur. Noise in the signals can cause GPS errors. Satellite clock errors, which are not corrected by the control station, can result in GPS errors. Ephemeris data errors can also occur. Tropospheric delays (due to changes in temperature, pressure and humidity associated with weather changes) can cause GPS errors. Ionospheric delays can cause errors. Multipath errors, caused by reflected signals from surfaces near the receiver that either interfere with or are mistaken for the signal, can also lead to GPS errors.

Despite the accuracy provided by LGBs, IGMs, SGMs, and GPR-based munitions the PGMs still occasionally inadvertently engage at or near friendly troops, sites, civilians or important collateral targets. This may be due to other factors as well, such as target position uncertainties, sensor errors, map registration errors and the like. This problem is increasingly important, both because domestic and world opinion is becoming increasingly sensitive to friendly fire and collateral damage, and because adversaries are more frequently deliberately placing legitimate military targets near potential targets of substantial collateral damage.

SUMMARY OF THE INVENTION

A munition is described which includes an integrity verification system that measures the integrity of the munition. When an integrity threshold is not met, engagement of the munition with a predetermined target is aborted. Also described is a methodology for gating the engagement of the munition with the target. The methodology includes performing an integrity check of the munition before the munition passes a point of no return. The method further includes aborting the engagement of the target when the integrity check of the munition fails.

BRIEF DESCRIPTION OF THE DRAWINGS

The invention will be more fully understood from the following detailed description taken in conjunction with the accompanying drawings, in which.

DETAILED DESCRIPTION OF THE INVENTION

The problem of inadvertently engaging at or near a friendly or important collateral target is addressed by building into the weapon engagement process one or more "go/no-go" decision points wherein the engagement of the munition with the intended target can be aborted if an integrity threshold associated with the munition is not met.

Weapon integrity is defined as a calculated confidence that an unintended engagement cannot occur. Weapon accuracy is defined as a calculated confidence that an intended engagement will occur. The presently disclosed invention utilizes a principle that weapon accuracy is distinct from weapon integrity, and that for many purposes, it is desirable to gate munition go/no-go decisions based on weapon integrity rather than weapon accuracy. Protection against unintentional engagement of neutral and friendly targets is better assured with weapon integrity rather than with the traditional solution of weapon accuracy. The problem addressed by the present invention concerns what steps can be taken once an engagement process is underway, and some problem occurs (e.g., GPS errors, munition steering malfunction, adverse weather conditions, etc.) that would prevent the munition from guaranteeing a desired probability that it will not engage an unintended target. Typically, a measure of integrity (assurance that the munition will not engage an unintended target) would be lost in such a situation with the result that the munition would miss the intended target, and could engage friendly troops, civilians or provide collateral damage to unintended targets.

Figure 1:
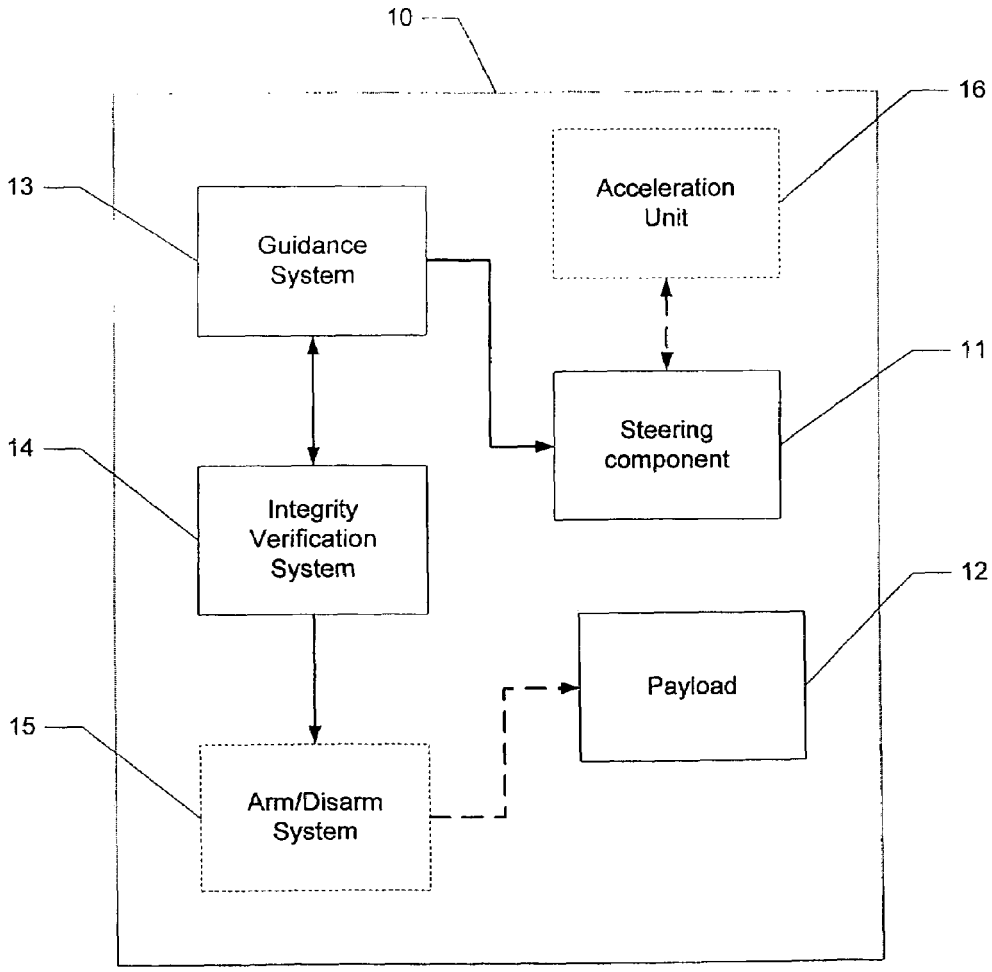
FIG. 1 comprises a block diagram of a munition according to the present invention.

Referring to FIG. 1, a munition 10 in accordance with the present invention is shown. Munition 10 includes a steering and acceleration component 11, a payload 12, an integrity verification system 14, a guidance system 13 and an arm/disarm component 15. Examples of munitions include Joint Direct Attack Munitions (JDAMs), Tomahawk missiles and Joint Standoff Weapon (JSOW) munitions. JDAMs and JSOWs are glide bombs, while the Tomahawk is a powered cruise missile. In general, the present invention applies to systems with these sorts of sensors available before an irrevocable decision related to continuing an engagement. This can include the decision to fire or release a non-PGM submunition from a larger munition, or the decision to fire or release a non-PGM munition from a ship, aircraft, and the like. Different munitions can be provided with various payloads 12. For example, a JSOW is illustrative of different payloads, with variants including 145 combined-effect submunitions {AGM-154A (Baseline JSOW)}, 24 anti-armor submunitions {AGM-154B (Anti-Armor)}, and a 500 lb bomb {AGM-154C (Unitary Variant)}.

The steering component 11 is used to direct the munition to a predetermined target under the control of the guidance system 13. The steering component 11 comprises actuators (typically realized as controllable fins) that create aerodynamic torques and forces which cause the munition to follow a desired flight path. Alternately, an acceleration unit 16 may be included for certain types of munitions such as Tomahawk guided missiles.

The integrity verification system 14 is used to ensure that the munition is traveling on a correct path to the target. The check is performed by the integrity verification system, which may rely in some embodiments on data from the guidance system. Additionally or alternately, the integrity verification system includes sensors for assessing position and flight dynamics. The integrity verification system verifies the probability that the weapon will engage inside its allowable engagement zone, such probability referred to herein as the "integrity level." An integrity bound is the region within which an engagement should occur, to meet the integrity level. By way of example, an integrity level of 0.999 means that there is a one percent chance of the munition engaging outside of its allowable engagement zone.

Each munition, for a given integrity level, has a respective "integrity bound" which defines the area outside of which the munition may not engage in order to meet the integrity bound. For example, a particular munition may have an integrity bound of 20 meters to meet an integrity level of 0.999 and an integrity bound of 33 meters to meet an integrity level of 0.9999. In a particular use of the munition, it is provided an "alert limit" and a corresponding "integrity threshold." The alert limit is the region beyond which the munition is commanded not to engage, and the integrity threshold for the engagement is the commanded probability that munition will not engage beyond this alert limit. The alert limit can be provided implicitly, by taking the munition's integrity bound as the default alert limit. Similarly, the integrity threshold for the engagement can be provided implicitly by taking the munition's integrity level corresponding to the alert limit as the default integrity threshold. Once the integrity threshold and corresponding alert limit are known, the integrity verification is a determination, based on sensor input, that the munition will not engage beyond the alert limit.

In an operational device, this high level function may be decomposed into one or more distinct tests. For examples, tests that the guidance system is working properly, tests that the steering is actually moving the munition as guidance commands, tests that the munition is on the desired flight path (within some allowed error limit), tests that the projected uncertainty of the impact point is within a required zone, tests that if the GPS signal is lost the munition is close enough to the intended impact point for inertial navigation to have a sufficiently small error, and tests that internal health checks are passed.

The check is performed by a processor which is part of the integrity verification system 14. The processor has high safety assurance characteristics for munitions with very high integrity probabilities. All the then feasible integrity checks are performed just before a major go/no-go decision point. Major go/no-go decision points will vary somewhat by weapon type and arm/disarm mechanism, but may include weapon launch/release, reaching the last point beyond which it is too late to safely steer to a designated "divert" location, reaching the altitude below which fragments from a self-destruct will not be slowed to terminal velocity before impact (for an abort by self-destruct), reaching the altitude below which excessive weapon effects would reach the ground, and reaching the altitude for planned weapon detonation (for an abort that comprises impacting the ground rather than engaging in a planned air burst). Additionally, some integrity verification tests may occur on a continuous or interrupt basis, such as a test performed immediately if the GPS signal is lost, or continuously monitoring of a WAAS signal. If the munition is not at the last go/no-go decision point, then in some cases a test that would result in an abort if this were the last decision point will result in a "wait for a later decision point" if there will be more go/no-go points in the future. For example, a munition with GPS and INS has GPS jammed, but at the time of a particular integrity verification the munition could still travel a distance before reaching the point where it would have to divert to a "safe" location and still be confident of making it using only the INS (i.e., the point of the last go/no-go decision). Thus, when an integrity check fails, then an abort operation is required, however, certain failures will not require an immediate abort, because later go/no-go decision points will remain that are not compromised by that particular failure. In this case, the failed verification check results in a "wait for later decision point" result rather than an abort. If however, the GPS is still jammed at the final go/no-go decision point, then abort results.

In some embodiments the munition 10 includes an arm/disarm system 15 in communication with the integrity verification system 14. The arm/disarm system 15 is used to either arm or disarm the payload 12. In embodiments that do not include an arm/disarm system 15, the "disarm" function can be accomplished by the integrity verification system sending a command to the guidance system 13 to guide the munition to a divert location. Preferably, the arm/disarm system 15 is present in order to permit an abort to occur even if the cause of the failed integrity verification check is the guidance system.

The initial targeting is provided to the guidance system by Command and Control ($C^2$). In addition, the alert limit is also provided. The alert limit may be generated by $C^2$ and explicitly commanded to the munition. For very sophisticated munitions the alert limit can be a variable, but for other munitions it could be determined from a short menu or look-up table in response to the integrity bound (e.g., "20 m for 0.999," "33 m for 0.9999," or "65 m for 0.99999"). Other munitions may have a fixed integrity bound, which corresponds to a predetermined alert limit.

For many PGMs the targeting information is input prior to launch. It has been a recent trend, however, for some PGMs to accept retargeting commands in flight. For munitions where this is allowed, the same communications channel may allow a change in flight in the desired integrity level (e.g., from "0.9999" to "0.999").

Some collection of the data by on-board sensors is required in order to perform the integrity verification check. In some cases (e.g., using WAAS data) additional integrity data may be provided by outside systems such as the guidance system 13.

Figure 2:
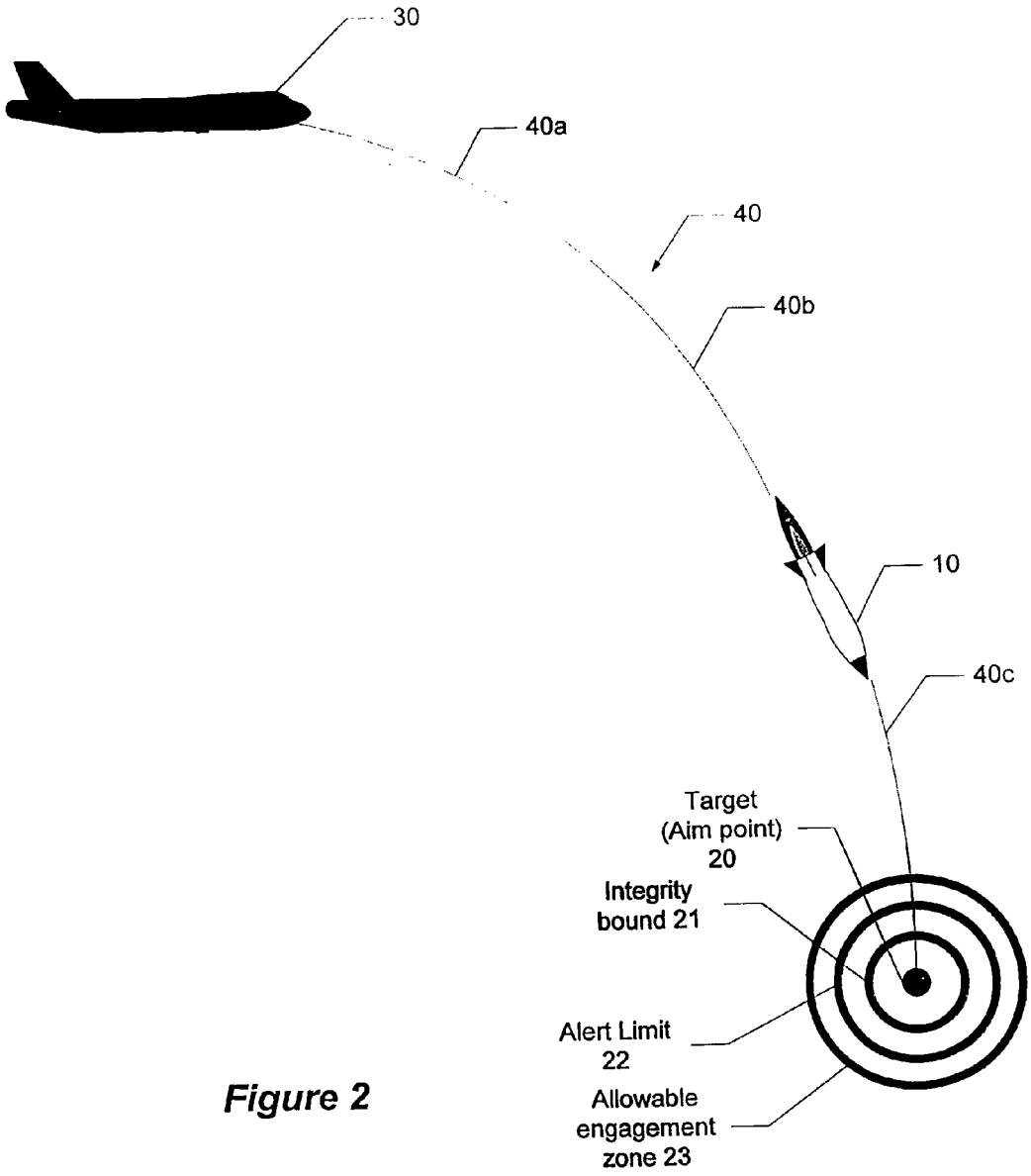
FIG. 2 is a diagram showing the path of a munition from deployment to engagement with an intended target.

Referring now to FIG. 2, the path of a munition 10 is shown from deployment of the munition from an aircraft 30 to engagement of an intended target 20. The munition is a precision guided munition and is one of a GPS guided munition, a laser guided munition, an inertial guided munition, a seeker guided munition, or other type of guided munition.

The intended target 20 is selected based on any number of criteria and can comprise enemy troops, enemy sites such as communication systems, electrical power systems, enemy weapons storage locations, or enemy infrastructure. The intended target may also include physical infrastructure such as bridges, dams, roads or the like.

Once the intended target has been identified, the proper weapon is selected. The weapon selection is also based on several criteria such as the proximity of the intended target 20 to friendly interests, the type of munition which can meet the objective of destroying the target while minimizing damage to collateral structures, the required accuracy needed with respect to the munition chosen, weather conditions, how the weapon is deployed and the like. The existence or hypothesis of protected targets one wishes to not engage will set the allowable engagement zone, based on the assured distance between the intended target and the protected target(s). Weapon effects distance will depend on the nature of the munition, the environment, the hardness (i.e., resistance to damage) of the protected target(s), and potentially on the desired integrity level. Subtracting the weapon effects distance from the border of the allowable engagement zone will define the allowable miss envelope (alert limit). Proper weapon selection for this invention is to choose a weapon such that the integrity bound of the weapon at the desired integrity level fits within the allowable miss envelope of the intended target, for the particular engagement scenario.

After selection of the weapon most appropriate to meet the desired goals, the munition is transported to a predetermined location prior to being deployed. FIG. 2 shows an aircraft 30 that is used to carry the munition 10, though it should be appreciated the selected munition could be launched from a ship or from the ground.

Once the munition is released, the munition traverses a flight path 40 to the intended target 20. The munition 10 is guided along this path 40 by the guidance system of the munition 10. During the traversal of the flight path 40 from the delivery craft 30 to the intended target 20, one or more integrity checks are performed by the integrity verification system 14 of the munition 10. For example, a first check may be performed when the munition 10 is at the point 40*a*, a second check may be performed when the munition is at the point 40*b*, and a final check may be performed when the munition is at point 40*c*. These checks may be performed continuously, at predetermined intervals, or on an interrupt basis. Further the last check point 40*c* must occur on or before the munition reaches a point of no return (i.e., a point beyond which engagement with the target cannot be prevented.

Shown surrounding the target (also referred to as an aim point) 20 is the integrity bound 21. An integrity bound defines a zone around a potential intended aim-point, within which the integrity of a miss can be assured to the corresponding probability level. The alert limit 22 surrounds the integrity bound, and may, in some applications, be coincident with the integrity bound. An alert limit is the zone that one wants to assure that munition engagement is constrained within, for example, the maximum zone that includes an aim-point and excludes aim-points too near to friendly sites. Surrounding the alert limit 22 is an allowable engagement zone 23, which is the smallest zone that includes the intended target and a protected target. For some applications, this is the largest possible zone that can be assured to include the intended target and just barely include a protected target. The difference between the alert limit and the allowable engagement zone is the weapon effect distance. While the integrity bound 21, alert limit 22 and allowable engagement zone 23 are depicted as circles, some munitions (e.g. munitions with submunitions) have non-circular weapon effects, may as a result have non-circular integrity bounds.

The "allowable miss envelope" or "alert limit" is for an engagement. The munition has an integrity bound, and must be selected so that the integrity bound is less than or equal to the alert limit, at the same or higher integrity level. The munition may be fed the "alert limit." In this type of operation, the munition aborts if it will violate the alert limit. If no alert limit is provided, then the munition takes a pre-calculated integrity bound as its alert limit.

For any particular engagement scenario, a larger allowable engagement zone includes additional distance to account for weapon effects against the type of targets one wishes to avoid. When looking at a munition in isolation, the weapon effect distance is added to the integrity bound to get the total effect integrity bound.

When an integrity verification comes back negative, for example when the munition comprises a GPS guided munition the GPS signal has been lost, then the munition engagement with the intended target is aborted, or a "wait for a later decision point" result may occur if the check is not that the final check point. This engagement abortion reduces or eliminates any engagement of friendly sites or collateral damage which would have resulted had the engagement not been aborted. Aborting the engagement may take the form of self-destruction of the munition or directing the munition to predetermined safe location. Alternately, when the munition is already armed the munition can be disarmed by the arm/disarm component in order to abort the engagement. When the released munition is not yet armed, aborting the engagement can be done by the arm/disarm component intentionally failing to arm the munition.

Flow diagrams of the presently disclosed methods of gating munition engagement based on integrity verification are depicted in FIGS. 3, 5, 7A and 7B. The rectangular elements are herein denoted "processing blocks" and represent computer software instructions or groups of instructions. The diamond shaped elements are herein denoted "decision blocks" and represent computer software instructions, or groups of instructions which affect the execution of the computer software instructions represented by the processing blocks.

Alternatively, the processing and decision blocks represent steps performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and can be varied without departing from the spirit of the invention. Thus, unless otherwise stated the steps described below are unordered meaning that, when possible, the steps can be performed in any convenient or desirable order.

Figure 3:
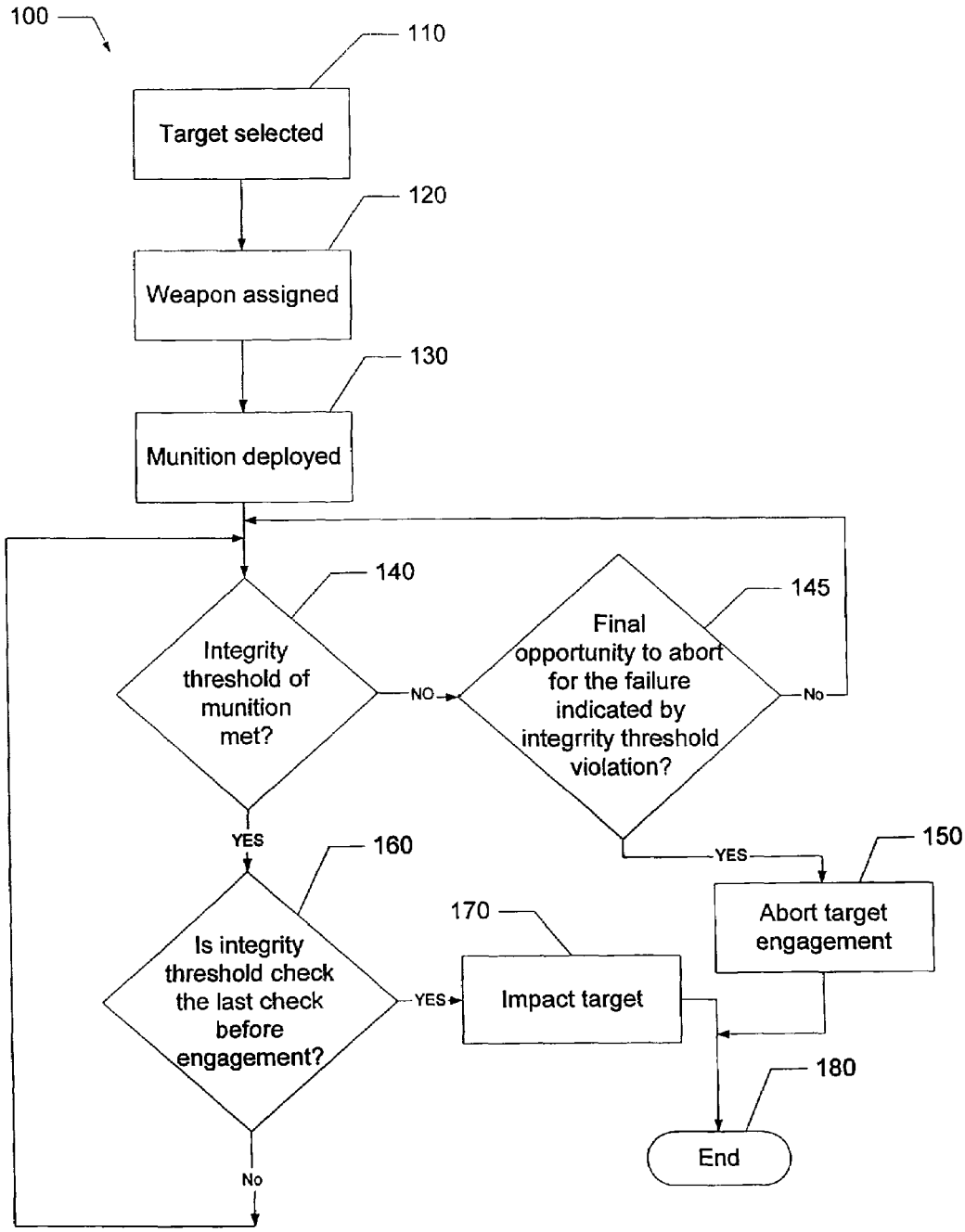
FIG. 3 is a flow chart showing the process for providing integrity gated munitions decisions.

A first process for gating munition engagement based on integrity information is shown in FIG. 3. The first step 110 of the process 100 involves selecting the desired target. The desired target is selected after a review of several criteria, as discussed above.

In step 120 the weapon is assigned. The proper weapon, considering the circumstances involving the intended target, is selected. There are once again several criteria that are used to select the best weapon for engagement of the intended target, as discussed above.

In step 130 the munition is deployed. Illustrative munition deployment can involve the munition being released from an aircraft, launched from a ship or launched from a ground source. Once the munition is deployed, the munition begins its track to the intended target.

In step 140 it is determined whether or not the desired integrity threshold for the munition is met. The integrity threshold can vary based on the type of munition and the type of guidance system used. For example, if a GPS guided munition is being used, a loss of the GPS signal would result in the integrity threshold not being met. For a LGM, debris or smoke in the air can prevent the guidance system from locking on the target by way of the laser. Other problems, regardless of the type of guidance system used, can also cause the integrity threshold to not be met. An example of this type of error is a problem with a fin on the munition such that the munition cannot be steered to the intended target. The integrity threshold of the munition can be checked several times between the time the munition is deployed and the time the munition impacts the target.

If the integrity threshold of the munition is not met, then step 145 is executed. In step 145 a determination is made regarding whether this is the final opportunity to abort before the failure indicated by the integrity verification threshold violation. For example, in munitions provided with both a GPS system and an IGS, a failure of the GPS may not result in an abort if the IGS can direct the munition to the intended target. When the determination is made that this is the final opportunity to abort then step 150 is executed, and when the determination is made that this is not the final opportunity to abort then steps 140 et seq. are executed.

The target engagement is aborted in step 150. As discussed, aborting of the target engagement can be accomplished in several ways. The munition can be diverted to an alternate location that is known to be safe in the event the munition detonates. The munition can be self-destructed before any damage to troops or sites on the ground occurs. When the munition is already armed, aborting the engagement can involve disarming the munition. When the munition is not yet armed, aborting the engagement can include intentionally failing to arm the munition.

If the integrity threshold of the munition has been met in step 140, then in step 160 a determination is made if the integrity check was the last check before engagement. If the integrity check is not the last check before engagement, then steps 140 et seq. are executed again.

If the integrity threshold check is the last check before engagement of the intended target then the munition continues on its track to the intended target and impacts the target in step 180.

The process ends in step 180 after the munition impacts the target or the target engagement is aborted.

Figure 4:
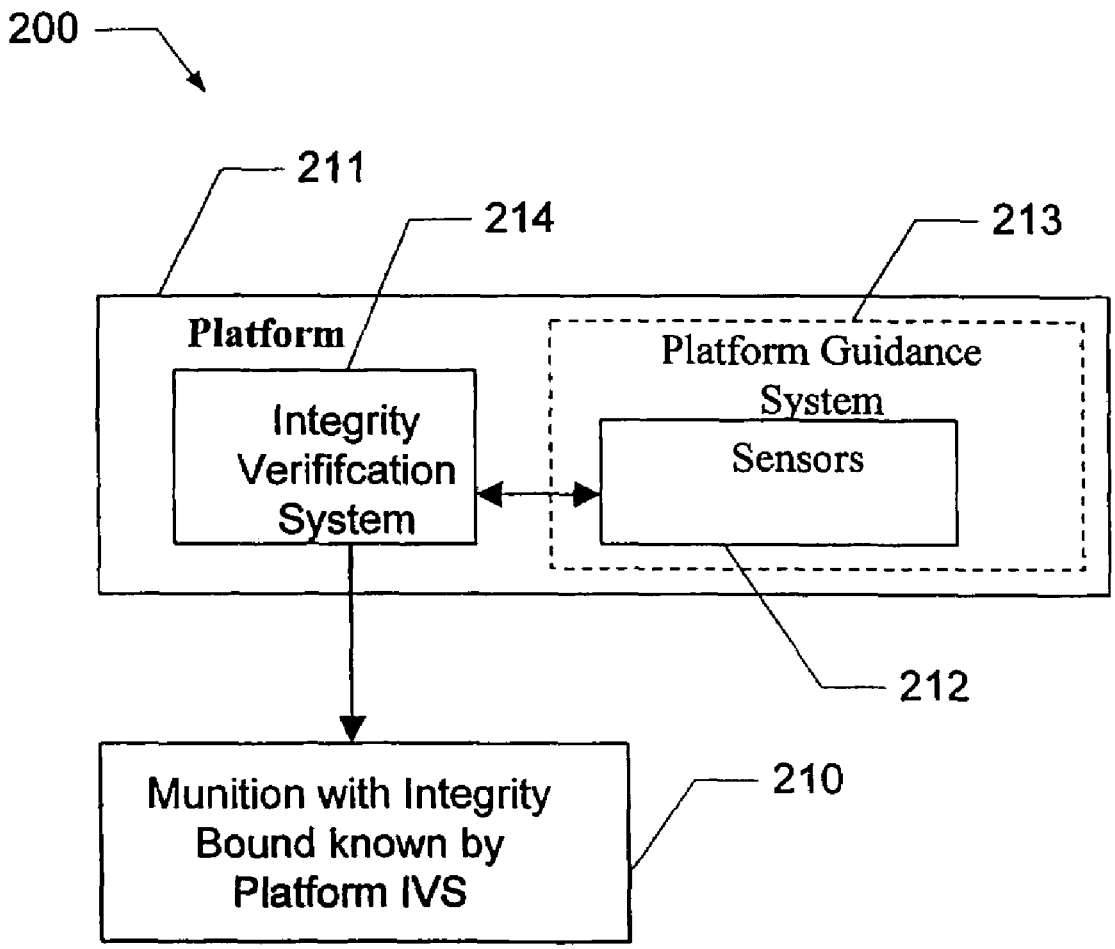
FIG. 4 is a diagram of an alternate embodiment of the present invention.

Referring now to FIG. 4, an alternate embodiment 200 of the present invention is shown. In this embodiment, the integrity verification system 214 is part of the platform 211 from which the munition 210 will be deployed. Also shown is the platform guidance system 213 which includes sensors 212. Sensors 212 communicate with the integrity verification system 214. With the embodiment 200, when the integrity verification system 214 detects a verification failure, a decision to abort the deployment of the munition is made before the munition is deployed. Here, the integrity verification system 214 is located on the platform 211 remote from the munition, and all it needs from the munition is the integrity bound for that munition that would result from that munition's release. The munition is not released if the munition integrity bound would exceed the desired protection level, at the desired integrity level. In most versions of this alternate embodiment, the platform operator would be notified of the failure to release, and the reason for this failure. For this purpose, the platform operator may be an automated system with responsibility over the platform.

Figure 5:
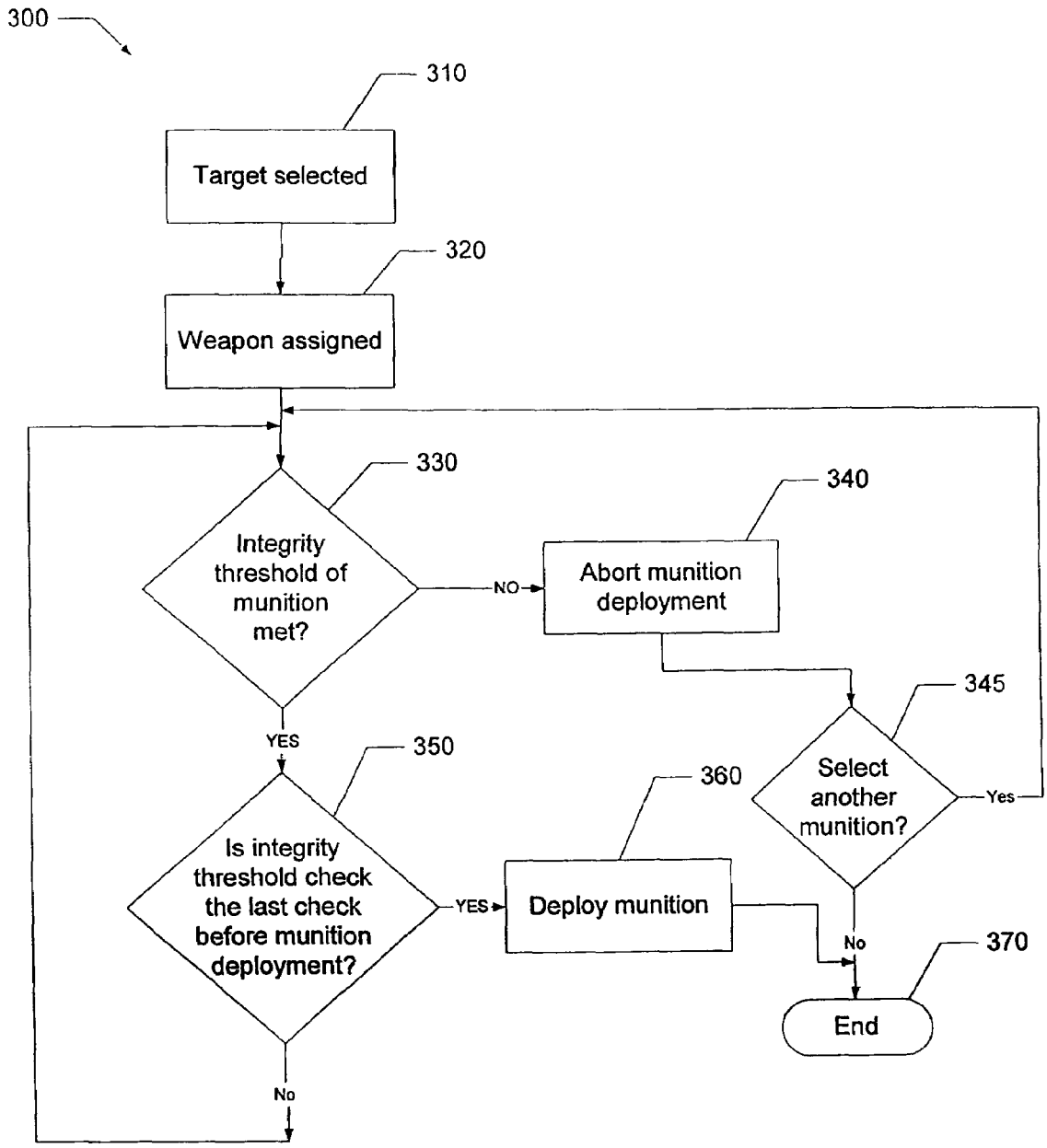
FIG. 5 is a flow chart of an alternate method for providing integrity gated munition decisions.

Another process for gating munition engagement based on integrity information for use with the system 200 is shown in FIG. 5. The first step 310 of the process 300 involves selecting the desired target. The desired target is selected after a review of several criteria, as discussed above.

In step 320 the weapon is assigned. The proper weapon, considering the circumstances involving the intended target, is selected. There are once again several criteria that are used to select the best weapon for engagement of the intended target, as discussed above.

In step 330 it is determined whether or not an integrity threshold of the munition is met. The integrity threshold can vary based on the type of munition and the type of guidance system used. The integrity threshold of the munition can be checked several times before the munition is deployed.

If the integrity threshold of the munition is not met, then the munition deployment is aborted in step 340. The aborting of the munition deployment can be accomplished by failing to release, launch, or otherwise deploy the munition. Following any abort of munition deployment, an optional function may then notify the platform of the failure to deploy, with potentially specific data about the integrity threshold violation.

In step 345 a determination is made as whether another munition should be selected. When the decision is to select another munition, then steps 330 et seq. are executed. When the decision is not to select another munition, then step 370 is executed.

If the integrity threshold of the munition has been met, then in step 350 a determination is made if the integrity threshold check was the last check before munition deployment. If the integrity threshold check is not the last check before munition deployment, then steps 330 et seq. are executed again. In some versions of this alternate embodiment, there will be only one integrity verification check, and step 350 may be omitted from the implementation.

If the integrity threshold check is the last check before munition deployment, then the munition is deployed in step 360.

The process ends in step 370 after the munition has been deployed or the munition deployment has been aborted.

Figure 6:
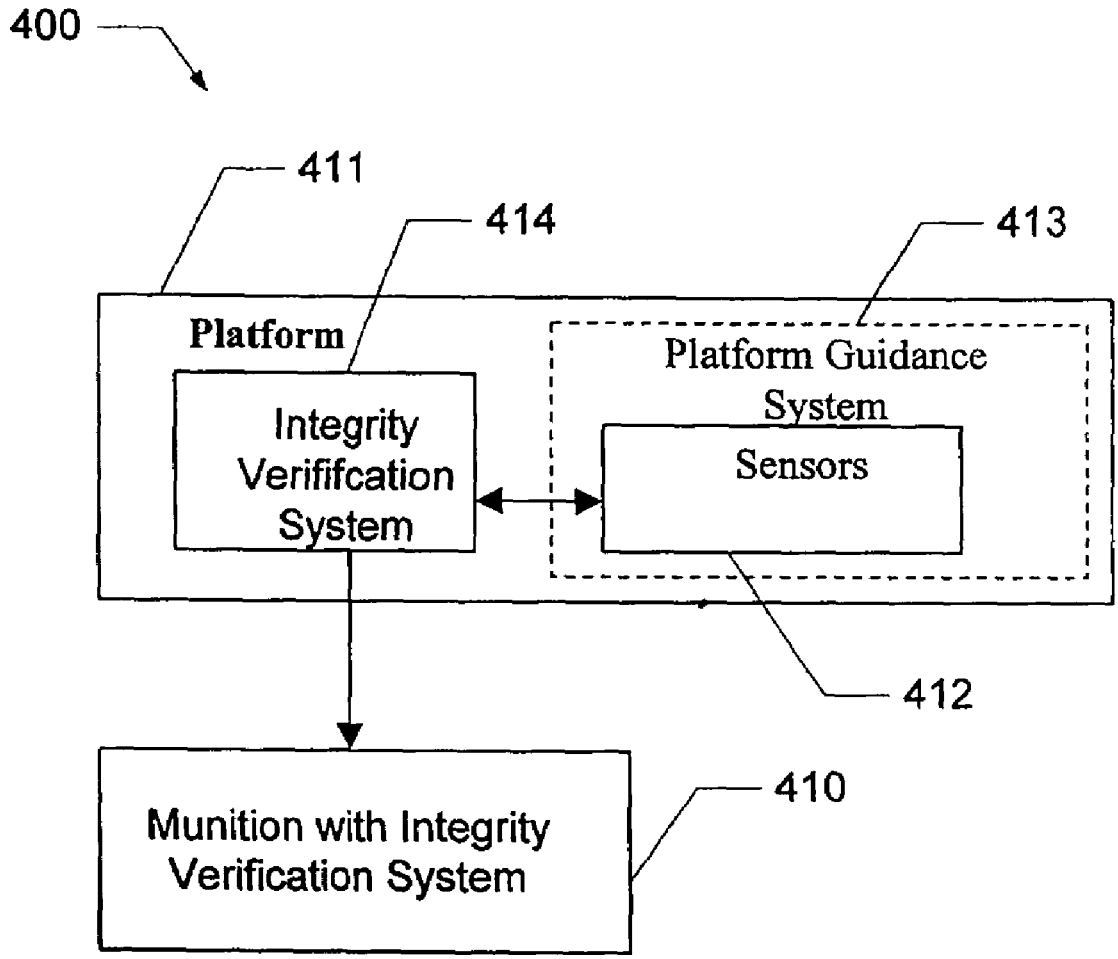
FIG. 6 is a block diagram of a hybrid system for gated munition deployment.

Referring now to FIG. 6, an alternate embodiment 400 of the present invention is shown. In this embodiment, a pre-deployment integrity verification system 214 is part of the platform 211 from which the munition 210 will be deployed. Also shown is the platform guidance system 213 which includes sensors 212. Sensors 212 communicate with the pre-deployment integrity verification system 214. With the embodiment 400, when the pre-deployment integrity verification system 214 detects a verification failure, a decision to abort the deployment of the munition is made before the munition is deployed. Here, the pre-deployment integrity verification system 214 is located on the platform 211 remote from the munition, and all it needs from the munition is the integrity bound for that munition that would result from that munition's release. The munition is not released if the munition integrity bound would exceed the desired protection level, at the desired integrity level. In most versions of this alternate embodiment, the platform operator would be notified of the failure to release, and the reason for this failure. For this purpose, the "platform operator" may be an automated system with responsibility over the platform. Additionally, the munition 410 includes it's own post-deployment integrity verification system, which is used once the munition is deployed.

The post-deployment integrity verification system included as part of munition 410 is used to ensure that the munition is traveling on a correct path to the target. The check is performed by the post-deployment integrity verification system, which may rely in some embodiments on data from the guidance system also includes as part of munition 410. Additionally or alternately, the post-deployment integrity verification system includes sensors for assessing position and flight dynamics. The post-deployment integrity verification system verifies the probability that the weapon will engage inside its allowable engagement zone.

Figure 7A:
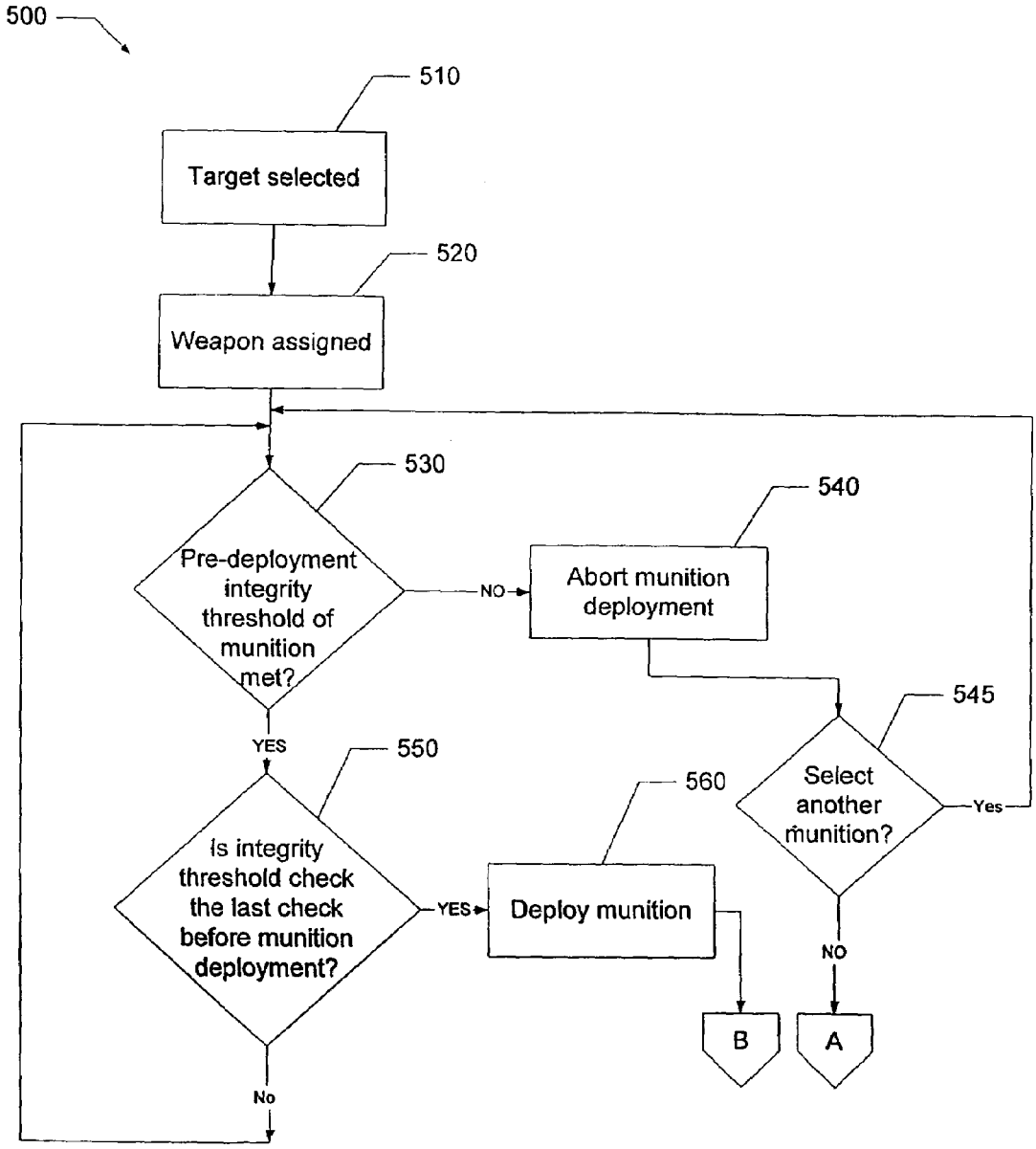
FIGS. 7A and 7B are a flow chart of another alternate method for providing integrity gated munition decisions.
Figure 7B:
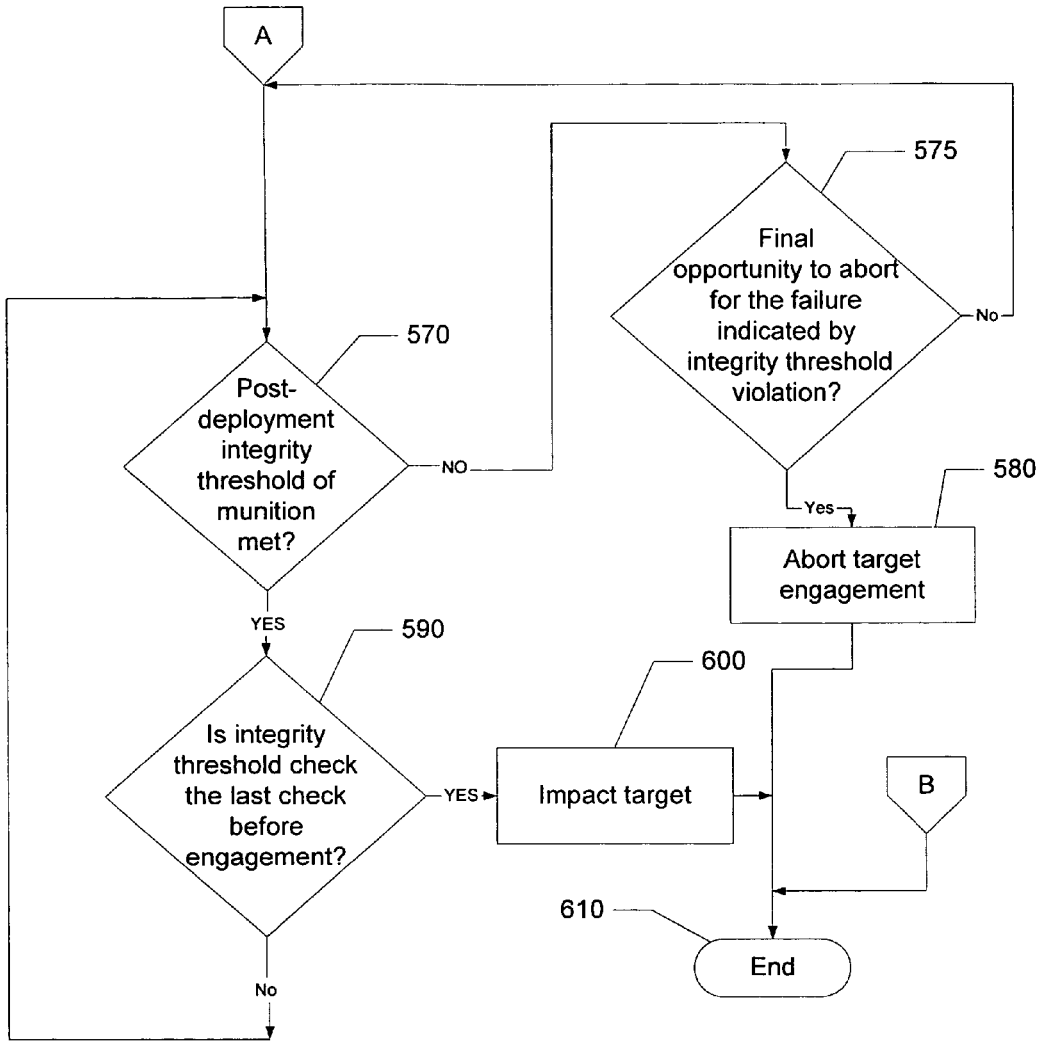

Another process for gating munition engagement based on integrity information for use with the system 400 is shown in FIGS. 7A and 7B. The first step 510 of the process 500 involves selecting the desired target. The desired target is selected after a review of several criteria, as discussed above.

In step 520 the weapon is assigned. The proper weapon, considering the circumstances involving the intended target, is selected. There are once again several criteria that are used to select the best weapon for engagement of the intended target, as discussed above.

In step 530 it is determined whether or not a pre-deployment integrity threshold of the munition is met. The pre-deployment integrity threshold can vary based on the type of munition and the type of guidance system used. The pre-deployment integrity threshold of the munition can be checked several times before the munition is deployed. This pre-deployment integrity verification is performed by the pre-deployment integrity verification system included as part of the platform, located remotely from the munition.

If the pre-deployment integrity threshold of the munition is not met, then the munition deployment is aborted in step 540. The aborting of the munition deployment can be accomplished by failing to release, launch, or otherwise deploy the munition. Following any abort of munition deployment, an optional function may then notify the platform of the failure to deploy, with potentially specific data about the integrity threshold violation.

In step 545 a determination is made as whether another munition should be selected. When the decision is to select another munition, then steps 530 et seq. are executed. When the decision is not to select another munition, then step 610 is executed.

If the pre-deployment integrity threshold of the munition has been met in step 530, then in step 550 a determination is made if the integrity threshold check was the last check before munition deployment. If the integrity threshold check is not the last check before munition deployment, then steps 530 et seq. are executed again. In some versions of this alternate embodiment, there will be only one integrity verification check, and step 550 may be omitted from the implementation.

If the integrity threshold check is the last check before munition deployment, then the munition is deployed in step 560.

In step 570 it is determined whether or not the desired post-deployment integrity threshold for the munition is met. The post-deployment integrity threshold can vary based on the type of munition and the type of guidance system used. For example, if a GPS guided munition is being used, a loss of the GPS signal would result in the integrity threshold not being met. For a LGM, debris or smoke in the air can prevent the guidance system from locking on the target by way of the laser. Other problems, regardless of the type of guidance system used, can also cause the integrity threshold to not be met. An example of this type of error is a problem with a fin on the munition such that the munition cannot be steered to the intended target. The post-deployment integrity threshold of the munition can be checked several times between the time the munition is deployed and the time the munition impacts the target.

If the integrity threshold of the munition is not met, then step 575 is executed. In step 575 a determination is made regarding whether this is the final opportunity to abort before the failure indicated by the post-deployment integrity verification threshold violation. For example, in munitions provided with both a GPS system and an IGS, a failure of the GPS may not result in an abort if the IGS can direct the munition to the intended target. When the determination is made that this is the final opportunity to abort then step 580 is executed, and when the determination is made that this is not the final opportunity to abort then steps 570 et seq. are executed.

The target engagement is aborted in step 580. As discussed, aborting of the target engagement can be accomplished in several ways. The munition can be diverted to an alternate location that is known to be safe in the event the munition detonates. The munition can be self-destructed before any damage to troops or sites on the ground occurs. When the munition is already armed, aborting the engagement can involve disarming the munition. When the munition is not yet armed, aborting the engagement can include intentionally failing to arm the munition.

If the integrity threshold of the munition has been met in step 570, then in step 590 a determination is made if the integrity check was the last check before engagement. If the integrity check is not the last check before engagement, then steps 570 et seq. are executed again.

If the integrity threshold check is the last check before engagement of the intended target then the munition continues on its track to the intended target and impacts the target in step 600.

The process ends in step 610 after the munition impacts the target or the target engagement is aborted.

A munition has been described wherein the munition includes an integrity verification system that measures the integrity of the munition. When an integrity threshold is not met, engagement of the munition with a predetermined target is aborted or otherwise prevented. Also described is a methodology for gating the engagement of a munition with a target. In one embodiment the methodology includes performing one or more integrity checks of the munition after it is deployed. In an alternate embodiment, at least one integrity check is performed before the munition is deployed. The method further includes aborting the engagement of the target when the integrity check of the munition fails. In a further embodiment a pre-deployment integrity check is performed and a post-deployment integrity check is performed.

Having described preferred embodiments of the invention it will now become apparent to those of ordinary skill in the art that other embodiments incorporating these concepts may be used. Additionally, the software included as part of the invention may be embodied in a computer program product that includes a computer useable medium. For example, such a computer usable medium can include a readable memory device, such as a hard drive device, a CD-ROM, a DVD-ROM, or a computer diskette, having computer readable program code segments stored thereon. The computer readable medium can also include a communications link, either optical, wired, or wireless, having program code segments carried thereon as digital or analog signals. Accordingly, it is submitted that that the invention should not be limited to the described embodiments but rather should be limited only by the spirit and scope of the appended claims. All publications and references cited herein are expressly incorporated herein by reference in their entirety.

What is claimed is:

1. A method comprising:

before a deployment of a munition to engage a target, performing an integrity check of the munition, the munition comprising a guidance system, performing the integrity check comprising determining if the munition will not engage the target beyond an alert limit; and aborting the deployment of the munition when the integrity check fails.

2. The method of claim 1, further comprising if the integrity check is successful, deploying the munition.

3. The method of claim 2, further comprising:

performing an additional integrity check of the munition after the deployment of the munition; and if the additional integrity check fails, aborting the engagement of the target with the munition.

4. The method of claim 1 wherein performing the integrity check of the munition comprises performing the integrity check of a precision guided missile (PGM).

5. The method of claim 1 wherein performing the integrity check of the munition comprises performing the integrity check of a munition having at least one guidance system selected from the group consisting of a laser guidance system, an inertial guidance system, a seeker guidance system and a Global Positioning System (GPS) guidance system.

6. The method of claim 5 wherein performing the integrity check of the munition comprises performing the integrity check of a munition having a GPS guidance system adapted to receive signals from a guidance integrity system.

7. The method of claim 6 wherein the guidance integrity system comprises a Space Based Augmentation System (SBAS).

8. The method of claim 7 wherein the SBAS comprises a Wide Area Augmentation System (WAAS).

9. The method of claim 1 wherein performing the integrity check comprises performing the integrity check a plurality of times before the munition is deployed.

10. The method of claim 3 wherein performing the additional integrity check comprises performing the additional integrity check a plurality of times before the munition engages the target.

11. The method of claim 1 wherein aborting the engagement of the target comprises determining if an integrity error is recoverable;

if the integrity error is recoverable, not aborting the engagement of the munition with the target; and if the integrity error is not recoverable, aborting the engagement of the munition with the target.

12. The method of claim 3 wherein performing the additional integrity check comprises performing the additional integrity check at a rate selected from the group consisting of continuously, at predetermined intervals, and on an interrupt basis.

13. The method of claim 1, further comprising performing a final integrity check of the munition before the munition reaches a point of no return.

14. The method of claim 1 wherein aborting the deployment of the munition comprises selecting another munition to deploy.

* * * * *

UNITED STATES PATENT AND TRADEMARK OFFICE

CERTIFICATE OF CORRECTION

PATENT NO. : 7,207,517 B2
APPLICATION NO. : 11/056977
DATED : April 24, 2007
INVENTOR(S) : McKendree et al.

It is certified that error appears in the above-identified patent and that said Letters Patent is hereby corrected as shown below:

Column 1, lines 8-9, delete "entitled Munition With Integrity Gated Go-No-Go Decision," and replace with -- entitled "Munition With Integrity Gated Go-No-Go Decision",--.

Column 1, line 32, delete "warfare the" and replace with -- warfare, the --.

Column 3, line 44, delete "munitions the" and replace with -- munitions, the --.

Column 3, lines 51-52, delete "frequently deliberately" and replace with -- frequently and deliberately --.

Column 4, lines 42-43, delete "some problem occurs" and replace with -- some problems occur --.

Column 5, line 50, delete "examples," and replace with -- example, --.

Column 5, line 56, delete "lost the" and replace with -- lost, the --.

Column 6, line 19, delete "verification the" and replace with -- verification, the --.

Column 6, line 46, delete "munitions the" and replace with -- munitions, the --.

Column 6, line 52, delete "PGMs the" and replace with -- PGMs, the --.

Column 7, line 50, delete "Further the" and replace with -- Further, the --.

Column 8, lines 24-25, delete "munition the GPS signal" and replace with -- munition and the GPS signal --.

Column 8, line 27, delete "is not that the" and replace with -- is not the --.

Column 8, lines 32-33, delete "munition to predetermined" and replace with -- munition to a predetermined --.

Column 8, line 34, delete "armed the" and replace with -- armed, the --.

Column 8, line 64, delete "stated the" and replace with -- stated, the --.

Column 9, line 6, delete "step 120 the" and replace with -- step 120, the --.

UNITED STATES PATENT AND TRADEMARK OFFICE

CERTIFICATE OF CORRECTION

PATENT NO. : 7,207,517 B2
APPLICATION NO. : 11/056977
DATED : April 24, 2007
INVENTOR(S) : McKendree et al.

It is certified that error appears in the above-identified patent and that said Letters Patent is hereby corrected as shown below:

Column 9, line 11, delete “step 130 the” and replace with -- step 130, the --.

Column 9, line 16, delete “step 140 it” and replace with -- step 140, it --.

Column 9, line 32, delete “step 145 a” and replace with -- step 145, a --.

Column 9, line 39, delete “abort then” and replace with -- abort, then --.

Column 9, line 41, delete “abort then” and replace with -- abort, then --.

Column 9, line 54, delete “step 160 a” and replace with -- step 160, a --.

Column 9, line 59, delete “target then” and replace with -- target, then --.

Column 10, line 23, delete “step 320 the” and replace with -- step 320, the --.

Column 10, line 28, delete “step 330 it” and replace with -- step 330, it --.

Column 10, line 41, delete “step 345 a” and replace with -- step 345, a --.

Column 10, line 47, delete “step 350 a” and replace with -- step 350, a --.

Column 11, line 14, delete “it’s” and replace with -- its --.

Column 11, line 21, delete “includes” and replace with -- included --.

Column 11, line 34, delete “step 520 the” and replace with -- step 520, the --.

Column 11, line 39, delete “step 530 it” and replace with -- step 530, it --.

Column 11, line 57, delete “step 545 a” and replace with -- step 545, a --.

Column 11, line 63, delete “step 550 a” and replace with -- step 550, a --.

Column 12, line 7, delete “step 570 it” and replace with -- step 570, it --.

Column 12, line 24, delete “step 575 a” and replace with -- step 575, a --.

Column 12, line 29, delete “abort if” and replace with -- abort, if --.

UNITED STATES PATENT AND TRADEMARK OFFICE

CERTIFICATE OF CORRECTION

PATENT NO. : 7,207,517 B2
APPLICATION NO. : 11/056977
DATED : April 24, 2007
INVENTOR(S) : McKendree et al.

It is certified that error appears in the above-identified patent and that said Letters Patent is hereby corrected as shown below:

Column 12, line 31, delete “abort then” and replace with -- abort, then --.

Column 12, line 33, delete “abort then” and replace with -- abort, then --.

Column 12, line 46, delete “step 590 a” and replace with -- step 590, a --.

Column 12, line 51, delete “target then” and replace with -- target, then --.

Column 13, line 1, delete “embodiment a” and replace with -- embodiment, a --.

Column 13, lines 3-4, delete “invention it” and replace with -- invention, it --.

Column 13, line 17, delete “submitted that that the” and replace with -- submitted that the --.

Signed and Sealed this

Twentieth Day of November, 2007

JON W. DUDAS
*Director of the United States Patent and Trademark Office*